US005277599A

United States Patent [19]

Nilson

[11] Patent Number: 5,277,599

[45] Date of Patent: Jan. 11, 1994

[54] LOCKABLE CONTAINER FOR SECURING AN ELECTRICAL CONNECTOR

[76] Inventor: Donald L. Nilson, 758 W. Nopal, Mesa, Ariz. 85210

[21] Appl. No.: 965,694

[22] Filed: Oct. 23, 1992

[51] Int. Cl.[5] ..... H01R 13/44

[52] U.S. Cl. ..... 439/133; 70/57; 70/58; 70/38 A

[58] Field of Search ..... 439/133, 134, 149; 70/38 A; 70/57; 70/58; 70/DIG. 30

[56] References Cited

U.S. PATENT DOCUMENTS

| | | | |
|---|---|---|---|
| 2,643,787 | 6/1953 | Rockman | 220/3.2 |
| 2,654,073 | 9/1953 | Katz | 339/37 |
| 2,733,416 | 1/1956 | Evalt | 339/37 |
| 2,955,272 | 10/1960 | Gallardo | 339/37 |
| 4,063,110 | 12/1977 | Glick | 307/112 |
| 4,445,738 | 5/1984 | Wiencke | 439/133 |
| 4,451,101 | 5/1984 | Davis | 339/44 |
| 4,488,764 | 12/1984 | Pfenning et al. | 339/37 |
| 4,592,607 | 6/1986 | Pejovic | 339/37 |
| 4,615,575 | 10/1986 | Kossor | 339/82 |
| 4,669,281 | 6/1987 | Young | 70/57 |
| 4,673,230 | 6/1987 | Baumgart | 439/133 |
| 4,782,971 | 11/1988 | Hill | 439/133 |
| 4,998,422 | 3/1991 | Borgmann et al. | 70/38 A |
| 5,123,267 | 6/1992 | Appelbaum | 70/38 A |

FOREIGN PATENT DOCUMENTS

| | | |
|---|---|---|
| 2843948 | 4/1980 | Fed. Rep. of Germany . |
| 3311379 | 10/1984 | Fed. Rep. of Germany . |
| 1354173 | 1/1964 | France . |

*Primary Examiner*—P. W. Echols

*Attorney, Agent, or Firm*—Don J. Flickinger; Jordan M. Meschkow; Robert A. Parsons

[57] ABSTRACT

An inner housing telescopingly receivable by an outer housing for movement between an extended and a retracted position, biasing means for urging the inner housing into the extended position, and a lockable latch assembly for retaining the inner housing in the retracted position. A cut-out formed in the inner housing for receiving the electrical connector of an electrical appliance when in the extended position, and securably containing the electrical connector when in the closed position.

5 Claims, 3 Drawing Sheets

LOCKABLE CONTAINER FOR SECURING AN ELECTRICAL CONNECTOR

BACKGROUND OF THE INVENTION

1. Field of the Invention

This invention relates to lockable containers.

More particularly, the present invention relates to devices of the type used for containing and securing electrical connectors to prevent unauthorized use of electrical appliances.

2. Prior Art

Many common appliances, tools and games are electrically-powered and therefore have a cord with an electrical connector, such as a plug, for connection with an electrical outlet. For reasons of safety and to prevent unauthorized use of the appliances, tools or toys, various devices and methods have been developed to secure or otherwise prevent operation of these electrical devices. These include a locking cover to secure outlets, locking devices on the controls of the electrical devices, or locking devices for enclosing part or all of an appliance cord connector.

Securing outlets, has the disadvantage of requiring each outlet to be secured as well as requiring that a device be associated with a particular stationary electrical wall receptacle and therefore not being readily portable with one particular appliance.

Locking devices on the controls of an electrical device add substantially to the cost of manufacturing that device and can be very complex.

The most effective locking devices for preventing unauthorized use of an electrical device are those which are secured to the electrical connector. However, at the present time many of these locking devices are complex, large and bulky, relatively expensive to manufacture, or come in multiple pieces which may be lost, rendering the lcoking device unusable.

It would be highly advantageous, therefore, to remedy the foregoing and other deficiencies inherent in the prior art.

Accordingly it is an object of the present invention to provide an improved means for controlling the use of an electrical appliance.

Another object of the present invention is to provide improved means for selectively disabling electrical devices.

And another object of the present invention is to provide a container which lockably incapsulates an electrical connector or the like.

Still another object of the present invention is to provide a container for preventing unauthorized use of an electrical appliance, without modification to the appliance.

Still another object of the present invention is to provide a locking container which is compact and readily stowable.

Yet another object of the present invention is to provide a locking container which is of simple construction, inexpensive to manufacture with conventional techniques using various materials.

Yet still another object of the present invention is to provide a locking container which is readily usable allowing for quick and easy disabling of the electrical device.

A further object of the present invention is to provide a locking container which is versatile, able to accommodate electrical connectors of varying sizes.

Yet a further object of the present invention is to provide a locking container which is unincumbered, having relatively few parts.

And yet a further object of the present invention is to provide a locking container which may be closed and locked without the presence of a key at that time.

SUMMARY OF THE INVENTION

Briefly, to achieve the desired objects of the instant invention in accordance with a preferred embodiment thereof, provided is an outer housing including an endwall from which sidewalls extend, defining a space, and an inner housing telescopingly receivable by the outer housing and movable between a closed position and an open position. Further provided is biasing means, biasing the inner housing into the open position, and a latch assembly holding the inner housing in the closed position.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which.

DETAILED DESCRIPTION OF THE PREFERRED EMBODIMENT

Figure 1:
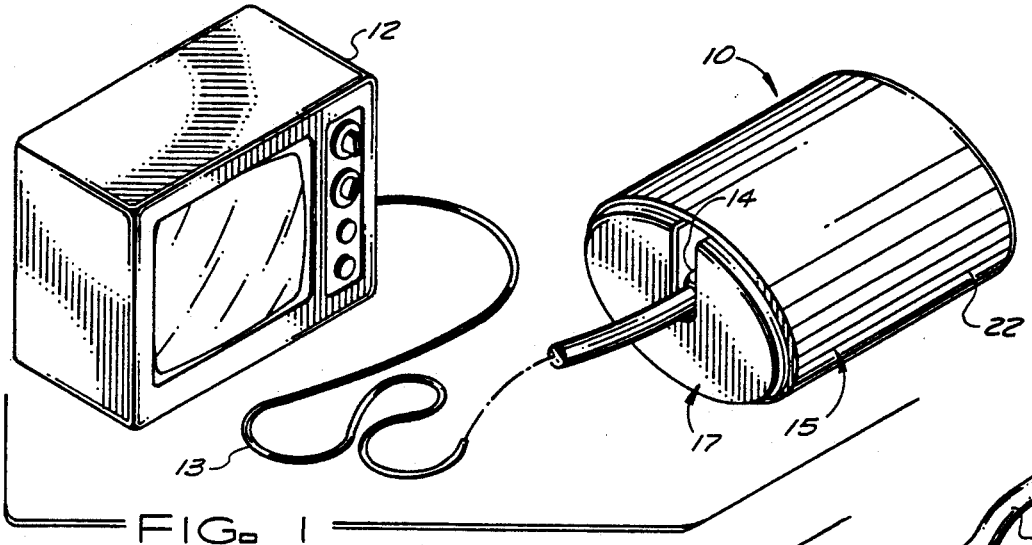
FIG. 1 is a perspective view illustrating a locking container for securing an electrical connector constructed in accordance with the teachings of the instant invention, as it would appear securing the plug of a television.

Turning now to the drawings in which like reference characters indicate corresponding elements throughout the several views, attention is first directed to FIG. 1, which illustrates a lockable container generally designated 10 for securing an electrical connector in a closed and locked position, disabling a television 12. While a conventional television 12 having a cord 13 terminating in an electrical plug 14 is illustrated, substantially any electrical appliance, tool or other device having electrical connectors such as plug 14 may be rendered inoperable. This is accomplished by securably containing electrical plug 14 in lockable container 10.

Figure 2:
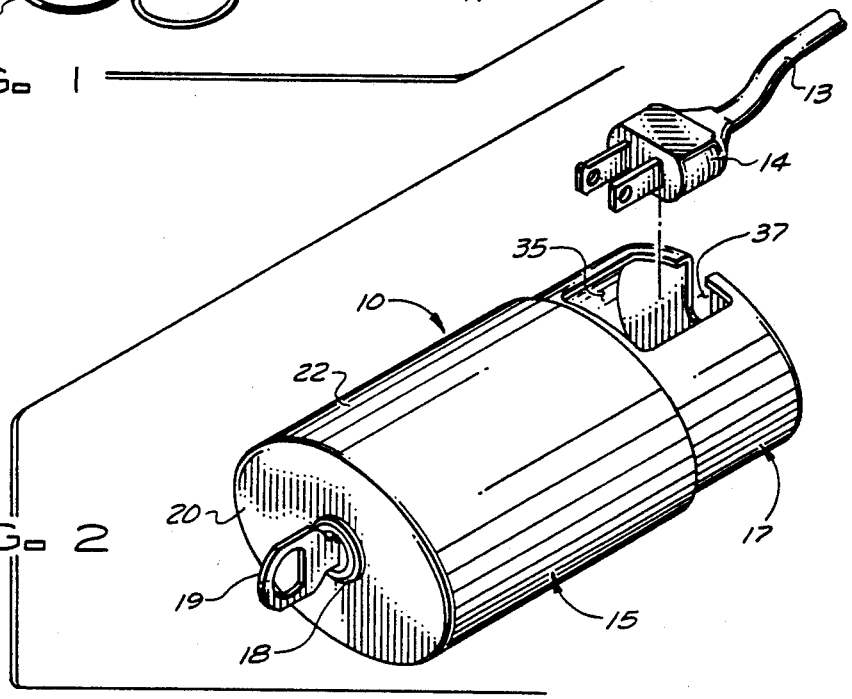
FIG. 2 is a perspective view illustrating the present invention in an open position, ready for receiving an electrical connector.
Figure 3:
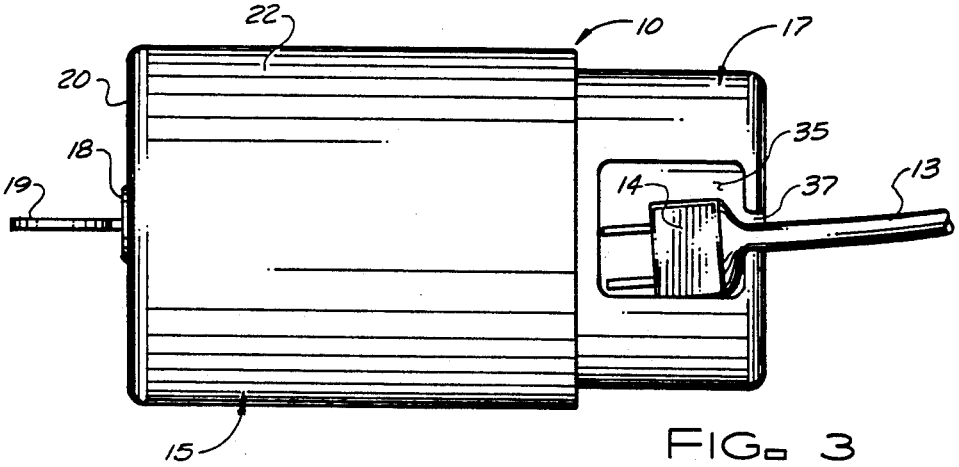
FIG. 3 is a top view of the locking container illustrated in FIG. 2.

Referring now to FIGS. 2 and 3, it can be seen that lockable container 10 includes an outer housing 15 and an inner housing 17 telescopingly received by outer housing 15, and movable between an open and closed position. Plug 14 is received by inner housing 17 when in the open position, and which may be moved to the closed position and secured by a lock mechanism 18 operated by a key 19.

Figure 4:
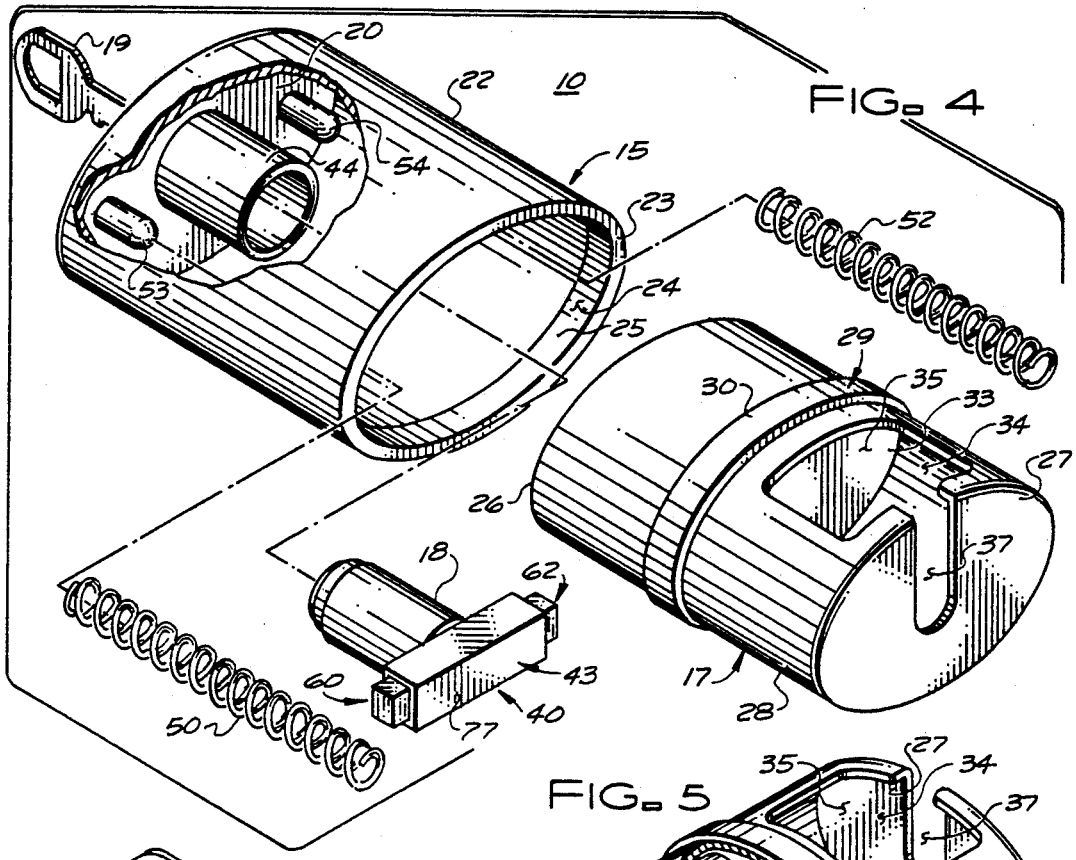
FIG. 4 is an exploded view of the locking container illustrated in FIG. 2.

Referring specifically to FIG. 4, an exploded view of lockable container 10 is illustrated. Outer housing 15 consists of an endwall 20, and a sidewall 22 extending therefrom and having a free end 23. Sidewall 22 forms an oval cylinder defining an interior space 24. Space 24 is accessed by an opening defined by free end 23 of sidewall 22. An inwardly directed lip 25 extends from free end 23 of sidewall 22.

Inner housing 17 consists of an endwall 27, and a sidewall 28 extending thereform and having a free end 26. Sidewall 28 forms an oval cylinder slightly smaller than outer housing 15. A raised strip 29 extends from sidewall 28 encircling inner housing 17. Raised strip 29 has an outer surface 30 with a diameter of a size sufficient to contact or reside proximate the inner surface of sidewall 22 of outer housing 15. An intermediate wall 33 extends from sidewall 28 parallel to endwall 27 and positioned intermediate endwall 27 and free end 26 of sidewall 28. A plug space 34 is defined between intermediate wall 33 and endwall 27. Plug space 34 is accessed by a cut-out 35 formed in sidewall 28, and a slot 37, formed in endwall 27 joining cut-out 35.

A latch assembly 40 consisting of a lock mechanism 18 and a latch mechanism 43 is mounted to endwall 20 of outer housing 15 by insertion into a cylindrical mount 44 extending from an opening (not shown) in endwall 20. Lock mechanism 18, is generally cylindrical in shape, and fits into mount 44 so that a keyhole is substantially flush with endwall 20, and the latch mechanism 43 extends into interior space 24.

Still referring to FIG. 4, biasing means, consisting of springs 50 and 52 extending the length of sidewall 22 and held in place by posts 53 and 54 extending inward from endwall 20 on opposing sides of cylindrical mount 44, urge inner housing 17 into the open position.

Figure 5:
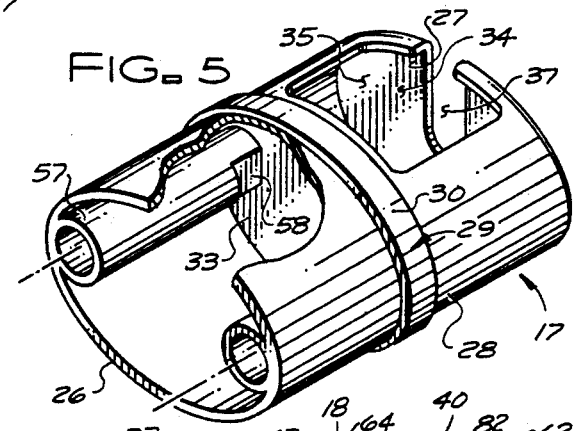
FIG. 5 is a perspective view of the inner housing, with a portion removed to allow viewing of the securing notches.

Referring to FIG. 5, inner housing 17 further includes spring guides consisting of tubes 55 and 57 extending along the inner surface of sidewall 28 of inner housing 17 from intermediate wall 33 to free end 26 of sidewall 28. Tubes 55 and 57 are configured to receive springs 50 and 52. Notches 58 are formed in tubes 55 and 57 proximate intermediate wall 33. Notches 58 are configured to receive latches 60, 62 of latch mechanism 43 when lockable container 10 is in the closed position.

Figure 6:
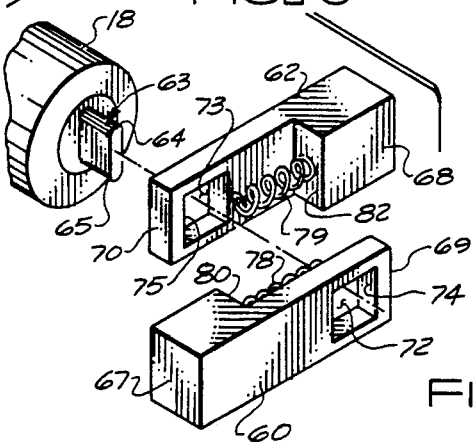
FIG. 6 is an enlarged perspective view of the latches of the latch assembly.

Referring to FIG. 6 latch assembly 40 consists of lock mechanism 18 and latch mechanism 43. Lock mechanism 18 consists of a conventional tumbler having a first end with a key hole and a second end with a tang 63 having cam edges 64 and 65, and movable between a locked and unlocked position by action of key 19 in the key hole. Latch mechanism 43 consists of latches 60 and 62 each having a contact end 67 and 68 respectively, and an opposing end 69 and 70. Opposing ends 69 and 70 have openings 72 and 73 extending therethrough respectively. Openings 72 and 73 have a camming surface 74 and 75 respectively. Latches 60 and 62 are held in a square tubular latch housing 77 having open ends. Latch housing 77 is affixed to lock mechanism 18 with tang 63 extending into latch housing 77 intermediate the open ends. Contact ends 67 and 68 extend outwardly from the open ends of latch housing 77. Biasing means are used to force latches 60 and 62 apart urging contact ends 67 and 68 outward and consists of coil springs 78 and 79. Coil springs 78 and 79 are compressed between shoulders 80 and 82 formed in latches 60 and 62 proximate contact ends 67 and 68 respectively, and opposing ends 69 and 70.

Figure 7:
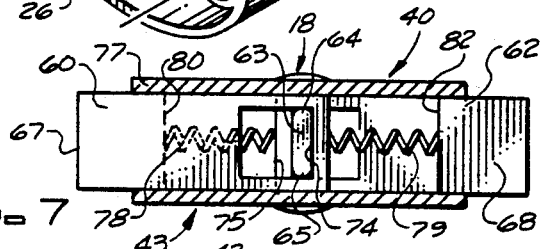
FIG. 7 is a cross-sectional view of the latch assembly with latches in the lock position.
Figure 8:
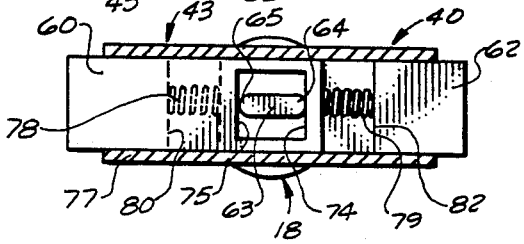
FIG. 8 is a cross-sectional view of the latch assembly with the latches in the retracted position.

As can be seen in FIGS. 7 and 8, latches 60 and 62 are positioned in latch housing 77 so openings 72 and 73 are overlapping and in partial alignment. Tang 63 extends through openings 72 and 73 and is sandwiched between camming surfaces 74 and 75 as coil springs 78 and 79 urge latches 60 and 62 outward to a locking position as illustrated in FIG. 7.

As tang 63 is rotated by key 19 in lock mechanism 18, cam edges 64 and 65 force cam surfaces 74 and 75 apart, fully aligning openings 72 and 73, and compressing springs 78 and 79. The alignment of openings 72 and 73 results in contact ends 67 and 68 being drawn inward, into an unlatched or unlocked position as seen in FIG. 8. Key 19 is rotated back, allowing springs 78 and 79 to force latches 60 and 62 outward, back to the latched position as shown in FIG. 7.

Figure 9:
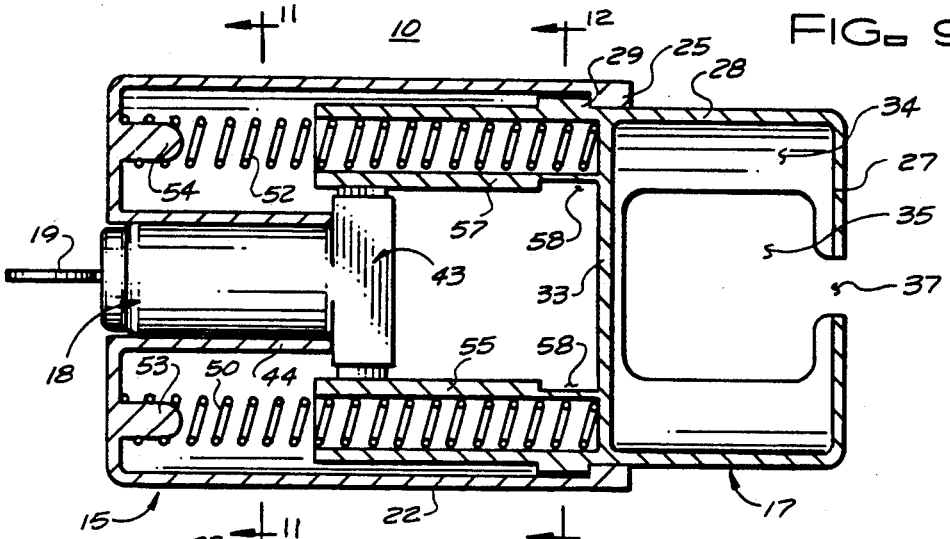
FIG. 9 is a cross-sectional view of the locking container illustrated in FIG. 2 in the open position.
Figure 10:
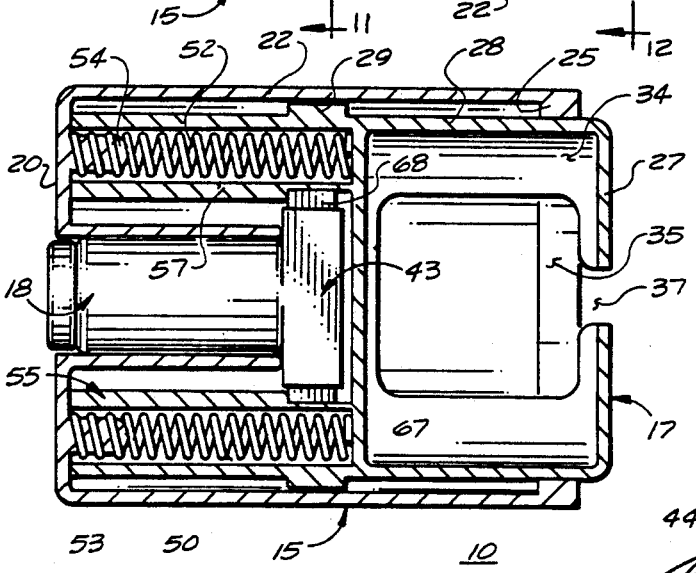
FIG. 10 is a cross-sectional of the locking container illustrated in FIG. 2 in the closed position.
Figure 12:
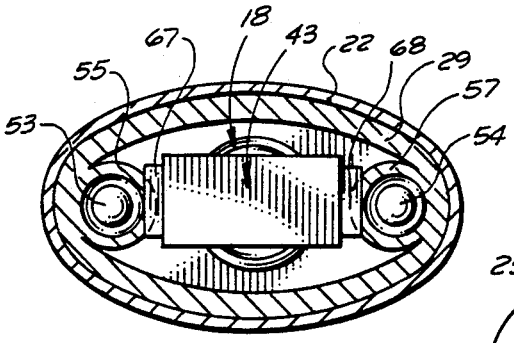
FIG. 12 is an end view taken along line 7—7 of FIG. 3.

Referring now to FIGS. 9 and 10, the interrelationship of the various elements can be seen. FIG. 9 illustrates locking container 10 in the open or unlocked position, with inner housing 17 biased outward allowing access through cut-out 35 and slot 37 to plug space 34. In this position, plug 14 may be inserted into plug space 34 through cut-out 35 with cord 13 exiting through slot 37, as illustrated in FIGS. 2 and 3. Inner housing 17 is telescopingly receivable within outer housing 15, and is movable between the extended position and a closed position. Raised strip 29 has a diameter that substantially matches the inner diameter of sidewall 22 as can be seen in FIG. 12, so that outer surface 30 slides along the inner surface of sidewall 22 of outer housing 15. In the extended or open position, inner housing 17 is biased outward, exposing cut-out 35 and slot 37, by springs 50 and 52 pressing against endwall 20 and intermediate wall 33. Springs 50 and 52 are retained in position by posts 53 and 54 at one end and tubes 55 and 57 at the opposing end.

Inner housing 17 is prevented from being completely removed from outer housing 15 by stop means, consisting of raised strip 29 and lip 25. As raised strip 29 slides along the inner surface of outer housing sidewall 22, it contacts lip 25, and is prevented from further extension.

Still referring to FIG. 9, latch mechanism 43 is positioned between tubes 55 and 57, with contact ends 67 and 68 of latches 60 and 62 retracted sufficiently to easily slide along the length of tubes 55 and 57 when inner housing 17 is retracted or extended within outer housing 15. When lockable container 10 is in the open or extended position, lock mechanism 18 may be turned to the lock position allowing latches 60 and 62 to be biased outward as illustrated in FIG. 7. However, latches 60 and 62 will remain retracted, being prevented from expanding by tubes 55 and 57. This allows lockable container 10 to be locked without the presence of a key as will be discussed below.

Referring now to FIG. 10–13, lockable container 10 is illustrated in the closed or locked position. Inner housing 17 is substantially entirely within outer housing 15, with springs 50 and 52 compressed between endwall 20 and intermediate wall 33. Contact ends 67 and 68 of latches 60 and 62 are extended and received by notches 58 formed in tubes 55 and 57. In this position, cut-out 35 is covered by outer housing 15, preventing removal of plug 14. This can be seen with reference back to FIG. 1. Slot 37 accommodates cord 13, which also can be seen in FIG. 1. As mentioned above, lock mechanism 18 may be turned to the locked position before closing lockable container 10, in which case upon movement of inner housing 17 to the closed position, latches 60 and 62 will be urged outward by coil springs 78 and 79, no longer being prevented from expansion by tubes 55 and 57. At this point, contact ends 67 and 68 will be received by notches 58 securing inner housing 17 in the closed or locked position. It will be understood by those skilled in the art that lockable container 10 may be locked after inner housing 17 has been moved to the closed position, by turning key 19 to the locked position thereby forcing latches 60 and 62 outward with contact ends 67 and 68 being received by notches 58.

Subsequently, lockable container 10 may be opened by turning key 19 to the opened position, wherein latches 60 and 62 are drawn inward with contact ends 67 and 68 being withdrawn from notches 58. Springs 50 and 52 are now free to move inner housing 17 outwardly, to the extended position.

Figure 11:
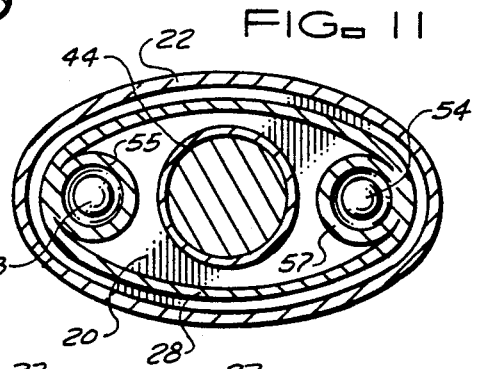
FIG. 11 is a end view taken along line 6—6 of FIG. 3.
Figure 13:
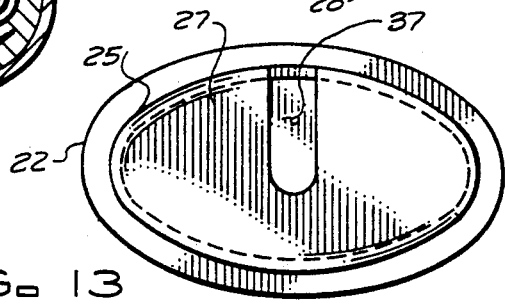
FIG. 13 is an end view of the present invention.

Referring specifically to FIGS. 11–13, it can be seen that inner housing 17 is received by outer housing 15. The oval shape of each, prevents any misalignment of elements, such as notches 58 and contact ends 67 and 68. However, it will be understood by those skilled in the art that substantially any shape, such as square, or round, may be used.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

I claim:

1. A lockable container for securing an electrical connector comprising:

an outer housing including an endwall, a sidewall extending from said endwall, having a free end, and defining an interior space, and a mount extending into said interior space from said endwall, an inner housing telescopingly receivable by said outer housing, and moveable between an open position and a closed position including an endwall, a sidewall extending from said endwall, having a free end, and receivable within said outer housing, an intermediate wall extending from said sidewall, intermediate said endwall and said free end, a plug space defined between said intermediate wall and said endwall, a cut-out formed in said sidewall admitting an electrical connector to said plug space in said open position, and covered by said sidewall of said outer housing in said closed position, and a slot formed in said endwall of said inner housing to accommodate a cord;

biasing means compressible between said outer housing and said inner housing, forcing said inner housing outwardly from said outer housing, into the open position, and including posts extending from said endwall of said outer housing on opposing sides of said mount, spring guides, carried by said inner housing between said intermediate wall and said free end, and springs having an end engaging said posts and an opposite end received by said spring guides;

a latch assembly carried by said outer housing, releasably holding said inner housing in the closed position; and stop means for preventing the complete removal of said inner housing from said outer housing.

2. A lockable container as claimed in claim 1 wherein said latch assembly includes:

a lock mechanism mounted in said mount of said outer housing; and a latch mechanism coupled to and actuated by said lock mechanism for engaging said inner housing in the closed position.

3. A lockable container as claimed in claim 2 wherein said stop means includes:

a lip extending inwardly from said free end of said outer housing sidewall; and a raised strip encircling said inner housing sidewall, configured to engage said lip in the open position.

4. A lockable container as claimed in claim 1 wherein said latch assembly includes:

a lock mechanism mounted in said mount of said outer housing having;

a tumbler with a first end and a second end, a key hole at said first end, a tang moveable between a locked and an unlocked position extending from said second end, a latch mechanism coupled to said second end of said lock mechanism, having;

a tubular latch housing with opposing open ends, said tang extending thereinto intermediate said open ends, a first latch extending from one of said open ends of said tubular latch housing, moveable between a locked and unlocked position, a second latch extending from the other of said open ends of said tubular latch housing, moveable between a locked and unlocked position, biasing means, urging said first and second latches into the locked position.

5. A lockable container as claimed in claim 4 further comprising notches formed in said spring guides proximate said intermediate wall, for receiving said first and second latches in said closed position.

* * * * *